United States Patent [19]

Hirako et al.

[11] Patent Number: 4,859,293

[45] Date of Patent: Aug. 22, 1989

[54] PROCESS FOR REFINING GOLD AND APPARATUS EMPLOYED THEREFOR

[75] Inventors: Mamoru Hirako, Yokohama; Nobuyasu Ezawa, Tokyo, both of Japan

[73] Assignee: Tanaka Kikinzoku Kogyo K.K., Japan

[21] Appl. No.: 73,509

[22] Filed: Jul. 15, 1987

[30] Foreign Application Priority Data

| | | | |
|---|---|---|---|
| Jul. 16, 1986 | [JP] | Japan | 61-167615 |
| Jul. 16, 1986 | [JP] | Japan | 61-167616 |
| Jul. 25, 1986 | [JP] | Japan | 61-174948 |
| Aug. 21, 1986 | [JP] | Japan | 61-196350 |

[51] Int. Cl.[4] ..... C25B 1/24; C25C 1/20; C25C 7/00

[52] U.S. Cl. ..... 204/94; 75/108; 75/118 R; 204/111; 204/234; 204/235; 423/34; 423/38; 423/39; 423/43

[58] Field of Search ..... 75/118 R, 118 P, 108; 423/34, 38, 39, 43; 204/94, 111, 234, 235

[56] References Cited

U.S. PATENT DOCUMENTS

| | | | |
|---|---|---|---|
| 631,040 | 8/1899 | Greenawalt | 204/111 |
| 1,998,010 | 4/1935 | Girvin | 423/38 |
| 4,375,984 | 3/1983 | Bahl et al. | 75/108 |
| 4,612,093 | 9/1986 | Shor | 204/111 |

OTHER PUBLICATIONS

Perry's Chemical Engineers' Handbook, 6th ed., Perry et al., eds., McGraw-Hill Book Co., 1984, pp. 17-27 to 28.

*Primary Examiner*—John Doll
*Assistant Examiner*—Jeffrey Edwin Russel
*Attorney, Agent, or Firm*—Klauber & Jackson

[57] ABSTRACT

Disclosed are processes and an apparatus for refining gold. One of the processes comprises dissolving unrefined gold by use of iodine and/or an iodide compound to form a solution containing an iodide compound of gold, removing insoluble substances in the solution, reducing the ions containing the gold by use of an alkali to precipitate the gold of high purity. In this process, the iodine may be obtained by electrolyzing the iodide compound. The other process and the apparatus further comprise circulating the solution having been separated from the precipitated gold for reuse, and the alkali simultaneously produced by the above electrolysis is economically employed therein.

17 Claims, 1 Drawing Sheet

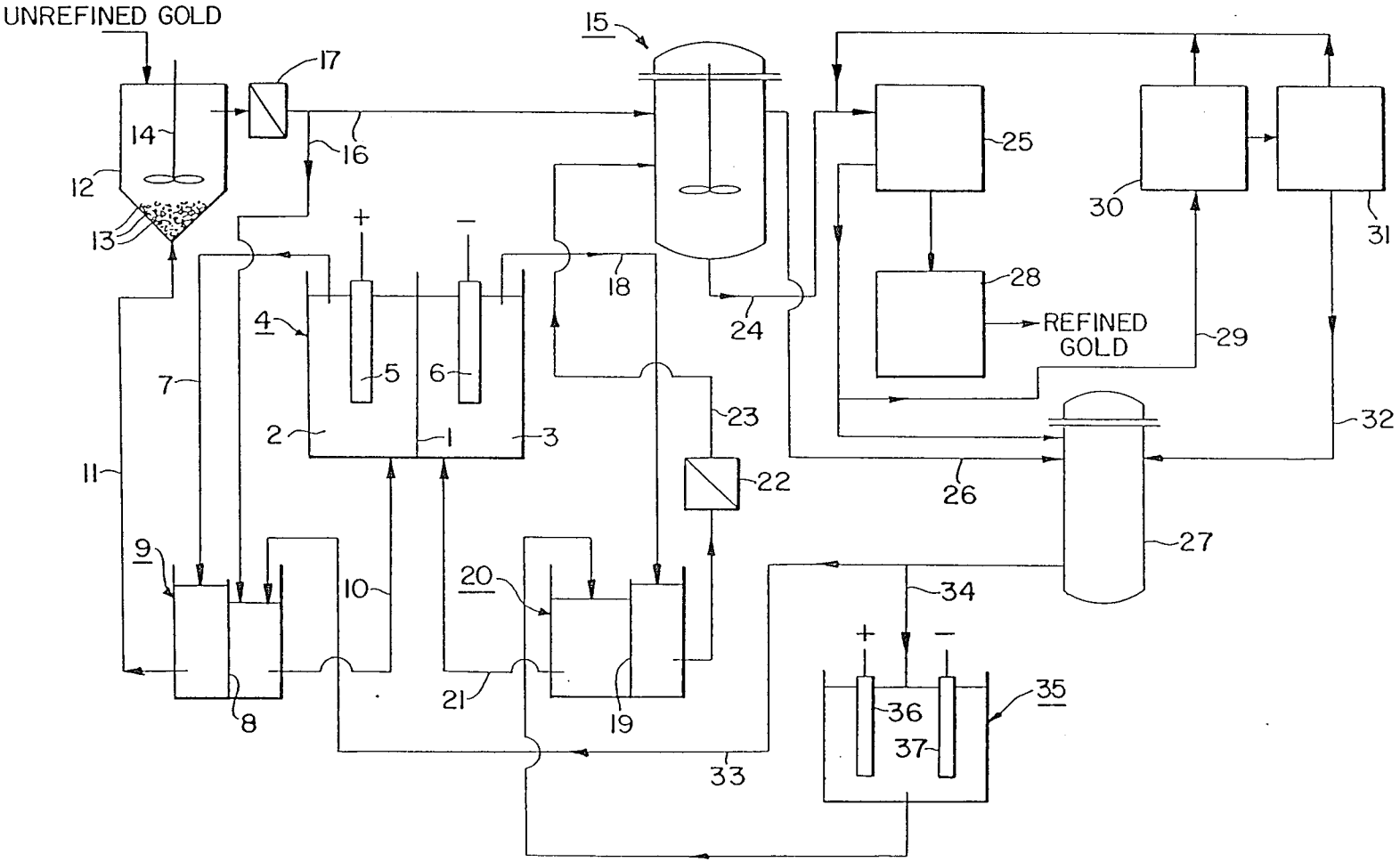
UNREFINED GOLD
REFINED GOLD
1
2
3
4
5
6
7
8
9
10
11
12
13
14
15
16
17
18
19
20
21
22
23
24
25
26
27
28
29
30
31
32
33
34
35
36
37

PROCESS FOR REFINING GOLD AND APPARATUS EMPLOYED THEREFOR

BACKGROUND OF THE INVENTION

The present invention relates to a process for refining gold comprising dissolving unrefined gold of relatively low purity into a solution and precipitating the gold by use of an alkali to obtain the the gold of high purity. The invention further relates to an apparatus which effectively carries out gold refining without adding any reagent by, after dissolving gold of relatively low purity into a solution, obtaining gold of high purity by means of precipitation employing an alkali, and by circulating the solution used for the refining, and to a process for refining gold employing the apparatus.

Heretofore, the following processes and the like have been known as gold refining processes; a process which comprises dissolving low grade gold by aqua regia or hydrochloric acid-chlorine solution and selectively reducing only gold by such a reducing agent as hydrazine; a process which comprises refining low grade gold in the acidic environment of hydrochloric acid by electrolysis.

However, the former process requires the equipment and labor for disposal of waste gases, and the latter process has the drawback that it generates chlorine gas at the anode since hydrochloric acid is employed as an electrolyte so that its electrolysis efficiency is low.

Also in the latter process, the concentration of the gold should always be maintained high, and in order to generate no chlorine gas, electrolysis should be carried out at a lower current density of not more than 3 $A/dm^2$ and consequently production capacity is low and excessive facilities are required.

As an improvement of a process for recovery of gold, a process has been known which comprises dissolving a gold compound as potassium gold iodide employing iodine and an iodide compound, and reducing the gold compound by means of a reducing agent to deposit and recover the gold (U.S. Pat. No. 3,957,505). Since the process is not a process for refining gold but a process for recovery of gold, no special consideration is given to the removal of impurities in the potassium gold iodide dissolved by use of iodine and the like though the existence of the impurities themselves may be recognized.

In the process of refining gold, it is required to effectively utilize reagents employed in the refining system to enhance the operation efficiency. In the prior art including the above U.S. patent, no or slight consideration is given to the enhancement of the operation efficiency, and the grade of gold obtained and its purity

SUMMARY OF THE INVENTION

As a result of earnestly pursuing an apparatus and a process without the above mentioned drawbacks, the present inventors have reached the present invention.

An object of the invention is to provide a process for obtaining gold of high purity from lower grade gold by means of simpler operation with substantially no evolved gas.

Another object of the invention is to provide an apparatus and a process for continuously obtaining gold of high purity from gold of relatively low purity by effectively manufacturing minimum reagents and effectively utilizing the reagents, which, of course, generate no exhausted gas and require substantially no reagents.

A first aspect of the invention is a process for refining gold comprising: forming a solution containing an iodide compound of gold by dissolving unrefined gold by means of iodine and/or an iodide compound; removing insoluble substances in the solution; reducing the gold solution by making the pH of the solution strongly basic which is not less than 12 to selectively precipitate the gold; and separating the precipitated pure gold from the solution after the reduction.

A second aspect thereof is an apparatus for refining gold comprising: an electrolytic cell for forming a solution containing an iodide compound of gold by the reaction of unrefined gold and iodine and/or an iodide compound, which is divided by a diaphragm into an anode chamber and a cathode chamber and electrolyzes the iodide compound-containing electrolyte to form an alkali hydroxide in the cathode chamber and iodine in the anode chamber; a removing means for removing impurities contained in the solution containing the iodide compound of gold, which is connected with the anode chamber of the electrolytic cell; a reduction vessel for selectively reducing and precipitating gold from the iodide compound of gold by making the pH of the solution strongly basic which is not less than 12 by virtue of mixing the solution breed from the impurities through the removing means and the alkali hydroxide produced in the above electrolysis, which is connected with both the removing means and the cathode chamber of the electrolytic cell; a separating means for obtaining refined gold by separating the precipitated gold from the solution after reduction; and a means for circulating the solution separated from the refined gold into the electrolytic cell for reuse.

A third aspect of the invention is a process for refining gold comprising; electrolyzing an electrolyte containing an iodide compound in an electrolytic cell using a diaphragm to form an alkali hydroxide and iodine in a cathode chamber and an anode chamber respectively to provide a solution containing an iodide compound of gold by the reaction between unrefined gold and the iodine and/or the iodide compound in the anode chamber; removing impurities in the solution; reducing the iodide compound of gold to selectively precipitate gold by adding the alkali hydroxide produced in the electrolysis to the solution to make the pH of the solution strongly basic which is not less than 12; obtaining the refined gold by separating the precipitated gold from the solution after the reduction; and circulating the solution separated from the refined gold to the electrolytic cell for reuse.

The iodine may be or may not be produced by electrolysis, and the solution may be or may not be circulated in the former process. However, the latter process and the apparatus of the invention are characterized in that the iodine is produced by electrolysis and the solution is circulated.

DETAILED DESCRIPTION OF THE INVENTION

The latter process of the invention comprises (I) a step of forming a solution containing an iodide compound of gold from unrefined gold electrolysis; (II) a step of removing insoluble substances from the solution; (III) a step of precipitating gold by reducing the gold species in the solution by means of making the pH of the solution having been removed of the insoluble substances strongly basic; (IV) a step of separating the precipitated gold from the solution after reduction; and (V) a step of circulating the solution separated from the gold to the above step (I) for reuse. The step (V) is not indispensable and the solution of the step I may be formed by any other method than the electrolysis in the former process. Each of the above steps will be hereinafter described.

(I) Step of Obtaining Solution of Iodide Compound

In this step, unrefined gold of relatively low purity is dissolved by using iodine and/or an iodide compound to form a solution of an iodide compound of gold.

The unrefined gold of relatively low purity includes from 8 carat gold (33% of purity) to gold of 99.99% of purity, and the relatively low purity means that said purity is lower than that after obtained the refining of the present invention. The unrefined gold may be employed in the case of further increasing the purity in solid gold having the purity of the above range which has been refined from gold in a waste solution and in the case of further raising the purity of ordinary gold ground metal and the like. A form of gold employed in the refining process of this invention may be any solid such as a plate, particles, flakes, powders, foil, a lump and the like. While the gold dissolved in liquid as described above may be employed, the gold should be converted into any one of the solids at least once.

In the latter process, the iodine and/or the iodide compound is obtained by electrolyzing a solution containing an iodide compound, for example, an alkali iodide using a diaphragm. However, in the former process, they can be obtained by other processes in addition to electrolysis.

In the refining of gold according to the invention, simultaneous use of iodine and potassium iodide is preferable.

The diaphragm electrolysis employed in this invention will now be described in detail.

The diaphragm electrolysis may be carried out combining the following various factors. Employing the present diaphragm electrolysis provides the advantage that since the iodide compound of gold is produced in the anode chamber and the alkali hydroxide is produced in the cathode chamber simultaneously, the alkali hydroxide can be employed as an alkali source in the precipitation of gold which will be described later.

(i) Electrolyte Composition:

The composition of the anolyte may be conveniently selected from the following three compositions, that is;

(a) MeI (Me is potassium or sodium, that is, MeI is potassium iodide or sodium iodide).

(b) $MeI+MeIO_3$ (potassium iodide+potassium iodate, or sodium iodide+ sodium iodate, or potassium iodide+sodium iodate, or sodium iodide+potassium iodate), and:

(c) $MeI+MeIO_3$+an electrically conductive salt (a sulfate, for example); wherein a total concentration of Me is between 1 to 5 M/l.

The composition of the catholyte may be selected from;

(d) MeOH (potassium hydroxide or sodium hydroxide);

(e) the electrically conductive salt+MeOH;

(f) the electrically conductive salt;

(g) water only; in addition to the above (a), (b) and (c). When the alkali iodate is contained as a catholyte, it is no longer necessary to carry out a waste gas treatment because the reaction proceeds with the below general equation (3) to generate no hydrogen gas.

It is preferable to maintain the pH of the both electrolytes in the range of 8~14 at the beginning of the reaction by adding potassium hydroxide of 0~2 N.

The electrically conductive salt mainly serves to increase the electrical conductivity of the electrolyte to reduce the quantity of the expensive iodide compound employed in the reaction.

When the electrolyte of the above composition, for example, having the solution of potassium iodide as the anolyte and the solution of potassium iodate as the catholyte is electrolyzed, the electrolysis reactions take place in the anode chamber and the cathode chamber according to the following general equations to provide iodine.

(Anode Chamber)

$$3\ KI \rightarrow 3/2\ I_2 + 3e^- + 3K^+ \quad (1)$$

$$Au + 3/2\ I_2 + KI \rightarrow KAuI_4 \quad (2)$$

$$(Au + 4\ KI \rightarrow KAuI_4 + 3\ e^- 3\ K^+ \quad (2')$$

(Cathode Chamber)

$$\tfrac{1}{2}\ KIO_3 + 3/2\ H_2O + 3\ e^- \rightarrow \tfrac{1}{2}\ KI + 3\ OH^-$$

(i) Process of Electrolysis:

(a) Direct Electrolysis:

The direct electrolysis in a process which comprises employing unrefined gold as an electrode and dissolving the electrode into an electrolyte by diaphragm electrolysis. The gold is dissolved according to the above reaction (2') in this process.

In this direct electrolysis, current is flown after the anode of the unrefined gold having the plate-like or porous shape is supported, or the unrefined gold is provided on a dimensionally stable noble metal electrode employing a suitable method (for example, a plate-like anode is laterally equipped, and the unrefined gold is placed thereon), in which the anode chamber is separated from the cathode chamber having the cathode of stainless steel or the like by a diaphragm which will be described later.

(b) Indirect Electrolysis:

The indirect electrolysis is a process in which current is flown to conduct the electrolysis with stirring in the anode chamber, if necessary, under the conditions that the commonly employed dimensionally stable noble metal electrode in place of the unrefined gold is used as the anode, and the unrefined gold is added in the form of particles to the anode chamber of the electrolytic cell. The gold is dissolved according to the above reaction equation (2) in this process.

In the apparatus and the process of this invention, the solution used for the electrolysis and gold precipitation is circulated so as not to discontinue the operation. Since the direct process is required to exchange the electrode due to the dissolution of the gold with the progress of the electrolysis, the indirect electrolysis which does not require the exchange of the electrode is preferably employed.

As described earlier, in the presence of the potassium iodide, the gold is dissolved by the iodine produced by the electrolysis of the potassium iodide. In the direct electrolysis, an electrolytic cell for forming iodine and an electrolytic cell for dissolving gold may be separately provided so that the anolyte containing the iodine produced in the above electrolytic cell for forming iodine can be moved through an appropriate conduit to the electrolytic cell for dissolving gold to conduct the dissolution of the gold therein.

In both direct and indirect electrolysis, the dissolution of the gold is carried out not only in the anode chamber but also a reaction vessel located outside of the electrolytic cell, which accommodates gold particles and is connected to the anode chamber of the said electrolytic cell so that the anolyte can be allowed to be circulated between the anode chamber and the reaction vessel to increase the dissolution efficiency. Further, the dissolution of the gold which may be conducted only in the reaction vessel is included in the indirect electrolysis.

(i) Electrolytic Cell:

Electrolytic cells employed in the present invention are not particularly restricted. A box-like electrolytic cell may be employed which is divided into an anode chamber and a cathode chamber by a diaphragm described later. The box-like electrolytic cell may be divided into a plurality of anode chambers and a plurality of cathode chambers to constitute a bipolar type electrolytic cell so that an electrolyte circulates among the plurality of the electrode chambers. An electrolytic cell having any shape and construction may be employed other than those described before.

In this diaphragm electrolysis, the formation of iodine and the dissolution of the unrefined gold by the iodine and the like may be conducted in a single cell or in individually separated cells. For the standpoint of economy and operation efficiency, these operations are preferably conducted in the single cell.

(ii) Electrolysis Conditions:

Although the dissolution of the gold itself is slightly affected by electrolysis conditions, the electrolysis is preferably carried out under the following conditions.

Temperature of Electrolyte . . . 20°~80° C.;
Current Density . . . 2~50 A/dm$^2$;
pH of Anode Chamber Side . . . 8~13;
pH of Cathode Chamber Side . . . Not less than 12.

(V) Diaphragm:

Any diaphragm which has been heretofore employed such as an asbestos membrane, a hydrocarbon membrane, an ion exchange membrane and the like may be employed. Since, however, an alkali hydroxide is produced in the cathode chamber as described earlier, the ion exchange membrane which has the superior alkali resistance, especially a fluroine-containing ion exchange membrane having sulphonic groups and/or carbonic groups is preferably employed..

Following are methods for producing an iodine compound of gold for use in the former process.

(A) Complex Iodine Method:

This method is a process which comprises forming iodide ions by reacting an alkali iodide potassium iodide, for example) and iodine, and reacting the iodide ions with unrefined gold to dissolve the unrefined gold into a solution as gold iodide ions. The reaction of the method employing potassium iodide as the alkali iodide is represented by the following general equations.

$$KI+I_2 \rightarrow K^+ + I_3^-$$

$$Au+3/2\ I_2+I^- \rightarrow [AuI_4^-]$$

The reaction can be carried out in solution employing an ordinary apparatus in accordance with a prior process. The reaction proceeds only by mixing and heating the potassium iodide, the iodine and the unrefined gold.

(B) Donnan's Dialysis Method:

The method is a process in which, for example, a solution containing iodine and an iodate salt is placed in one chamber of a container divided into two chambers by a cation exchange membrane, and the other chamber is connected to the cathode chamber of an electrolytic cell for a Glauber's salt so that the electrolyte thereof is circulated. When unrefined gold is added into the solution containing the iodine and the iodate salt in the container, the unrefined gold is dissolved as gold iodide ions.

(C) Dry Reaction Method:

The method is a process which comprises reacting unrefined gold and iodine in a solid phase to form gold iodide, and dissolving the gold iodide into a solution.

The solid phase reaction between the unrefined gold and the iodine proceeds with the following general equations.

$$Au+3/2\ I_2 \rightarrow AuI_3$$

$$Au+\tfrac{1}{2}\ I_2 \rightarrow AuI$$

(D) Chloroauric Acid Method:

This method is a process which comprises dissolving unrefined gold in aqua regia to form chloroauric acid (or chloroaurous acid) or gold chloride, and reacting these with an alkali iodide, for instance, potassium iodide to convert them into iodoauric acid (or iodoaurous acid) or potassium gold iodide. These reactions can be represented by the following general equations.

$$Au+\text{aqua regia} \rightarrow HAuCl_4\ (\text{or } AuCl_3)$$

$$HAuCl_4+4\ KI \rightarrow HAuI_4+4\ KCl$$

$$AuCl_3+4\ KI \rightarrow KAuI_4+3\ KCl$$

(E) Gold Chloride Process:

The method is a process which comprises, after reacting unrefined gold and chlorine in a solid phase to form gold chloride, reacting the gold chloride with an alkali iodide, for example, potassium iodide to form potassium gold iodide. The reactions can be represented by the following equations.

$$Au+3/2\ Cl_2 \rightarrow AuCl_3$$

$$AuCl_3+4\ KI \rightarrow KAuI_4+3\ KCl$$

(II) Step of Removing Insoluble Substances from Solution of Iodide Compound of Gold:

In the solution of the iodide compound of gold formed in the step (I) are contained insoluble substances and their ions mainly due to impurities in the unrefined gold. These are, for example, ions or compounds of iron, cobalt, nickel, tin, lead, silver, copper, calcium, magnesium and the like. The insoluble unrefined gold may be included therein.

The insoluble substances may be removed by filtration (an ordinary filtration operation and centrifugal dehydration) and sedimentation, or either may be used with ultrafiltration. In the present invention, the gold of high purity can be obtained only by the removing operation for the insoluble substances. However, in order to further increase the purity of the gold obtained, it is necessary to remove the above various ions.

For this purpose, the following operations may be employed.

(a) Precipitating Ions as Iodides Utilizing Composition of Solution:

This is a method utilizing the variation of solubility in which, for example, a slightly soluble iodide is precipitated by changing the solubility of the ions by dilution of the solution with water to react the metal ions with the iodide ions in the solution to form the slightly soluble iodide. The ions conveniently removed by the method are silver, lead and the like, and they are removed as silver iodide and lead iodide, respectively.

(b) Precipitating Ions as Hydroxides or Oxides by pH Control:

This is a method utilizing the variation of solubility of metal hydroxides or metal oxides by the variation of pH in which, for example, an alkali hydroxide is added to the solution to maintain the pH of the solution in the range of 8~12 in which the gold is not precipitated so that the ions of iron, cobalt, nickel, tin, lead and the like are precipitated as the hydroxides or the oxides to be removed by utilizing filtration or sedimentation.

(c) Forming Slightly Soluble Carbonates by Reaction with Carbonic Acid Gas in Air:

The carbonates of the II A group elements among the above metal ions, that is, of calcium and magnesium are sightly soluble, and can be easily removed because they are precipitated by stirring the solution with bubbling of air.

(d) Adding Additives to Form Slightly Soluble Salts:

The additives may be sulphates, carbonates (or carbonic acid gas), ammonium salts (or ammonia gas or ammonia water), EDTA and the like, and the appropriate additives can be selected in accordance with the kind of the metals to be removed.

(e) Crystallizing by Cooling Solution:

A considerable amount of silver iodate is precipitated by cooling the solution so that the silver ions can be removed from the solution.

(III) Step of Reducing Gold and Precipitating Metallic Gold by Making Solution Freed from Insoluble Substances Strongly Basic to Decompose Alkali in Solution After the insoluble substances are removed and, if necessary, the impurity metal ions are removed by adding the filtration auxiliaries in the above step (II), the solution is made to be basic which is not less than 12 to selectively precipitate the metallic gold from the ions in the solution including gold iodide ions and the like.

The precipitation reaction can be represented by the following general equation.

$$KAuI_4 + 3\ KOH \rightarrow Au + \tfrac{1}{2}\ KIO_3 + 7/2\ KI + 3/2\ H_2O \quad (4)$$

The temperature, the pH and the gold concentration as the metallic gold of the solution at the time of completion of the step (II) are about 20°~80° C., about 8~12 and about 5~100 g/l, respectively.

In order to make the solution basic, the solution of potassium hydroxide or sodium hydroxide produced in the cathode chamber of the electrolytic cell by the diaphragm electrolysis in the step (I) can be led through an appropriate conduit from the electrolytic cell to the place where the present step is carried out, and is used with no further treatment, which is advantageous from the standpoint of increasing the operation efficiency and of the economy.

Although use of the alkali hydroxide produced by the electrolysis is indispensable in the latter process and the apparatus of the invention, the other reagents such as commercially available alkali hydroxides, ammonia gas, ammonia water and the like can be employed in the former process of the invention.

The concentration of the basic solution to be added is desirably 0.1~6 N, and the volume ratio between the former solution and the basic solution is preferably in the range of about 1:0.15 to 1:5.

While the particle size of the precipitated gold obtained by this process is generally in the range of about 1 to 50 μ, the particles can be grown employing the following operations for obtaining larger particles.

Firstly, the supernatant of the solution containing the gold which has been precipitated by adding the basic solution is taken out, and to the remaining slurry containing the precipitated gold particles is added the solution containing the pre-reduction gold (the solution at the time of completion of the step II), and is further added the basic solution to reduce the gold again to grow the particles. By the treatment, for example, the particles of about 5~10 μ can be grown to the particles of not less than 25μ.

Secondly, after the gold obtained by the reduction is once filtered the gold particles obtained thereby are added to the above solution containing the pre-reduction gold, and the basic solution is further added thereto to reduce and deposit the gold onto the gold particles to grow the particle size.

Thirdly, to the solution containing the gold reduced and precipitated are added the solution containing the pre-reduction gold and the basic solution to grow the particle size by depositing the gold onto the precipitated particles. If necessary, this treatment can be repeated several times to obtain the particles having the desired size.

(IV) Step of Separating Precipitated Gold from Solution after Reduction:

Since the iodate ion, the alkali metal ion and iodine other than the precipitated gold are dissolved in the solution at the time of completion of the step (III), the precipitated gold should be separated from the solution to provide the pure gold. Such operations as flushing by use of an organic solvent in addition to the filtration and the sedimentation employed in the step (II) may be employed as a separating operation. The flushing means an ordinary extracting operation with water and an organic solvent. When such an organic solvent as chloroform is added to the above solution and the solution is shaken and allowed to stand, the gold moves into the organic phase and the other iodate ions, alkali metal ions and iodine remain in the aqueous phase so that the gold can be recovered from the organic phase.

The gold particles separated through the separating operation are washed employing a proper quantity of, preferably not less than three times of washing water, which is desirably pure water of 40°~100° C. to remove residual components to obtain the gold of high purity after drying.

The purity of the gold refined according to the invention depends also on the purity of unrefined gold before refining. Eight carat gold (not less than 33% of purity), can be made to be not less than 95%, and the unrefined gold of not less than 80% of purity can be made to be not less than 95%, and the unrefined gold of not less than 98% of purity can be made to be not less than 99.99%, and the unrefined gold of not less than 99.99% of purity can be made to be not less than 99.999%.

(V) Circulating Solution Freed from Gold to Step (I) for Reuse:

While this step is indispensable for the latter process and the apparatus of the invention, the step need not be employed in the former process.

Excess potassium iodate and potassium iodide are contained in the solution at the time of completion of the step (IV), which is circulated to the anode chamber and the cathode chamber of the electrolytic cell because it can be used as the electrolyte of the step (I) without further treatment.

A quite small amount of metals is included in the solution at the time of completion of the step (IV). If the solution is circulated to the electrolytic cell with no further treatment, the metals deposit onto the cathode of the electrolytic cell so that a regular removal operation thereof is required. Cessation of the electrolytic cell is cessation of the entire refining operation which lowers the efficiency. Therefore, it is preferable to separately provide, at a proper position of the circulating line for the above solution to the cathode chamber, an electrolytic cell having a simple structure, for example, the one having supported plate-like electrodes or an electrolytic cell having a complicated structure which comprises a plurality of electrodepositing cells connected with each other by means of bipolar type connection, to let the electrolyte pass the electrolytic cell to electrodeposit the impurities onto the cathode of the electrolytic cell.

The electrodeposition is preferably conducted at 0.5~10 A/dm$^2$ of current density and 20°~80° C. of temperature so as to remove the gold which has not been purified, the other noble and base metals.

During the electrodeposition, electrodeposition of metals and decomposition of iodate ions occur at the cathode side and formation of iodate ions occurs in the anode side. The mass balance of the whole system never goes wrong because no evolution of gases occurs.

Electrodialysis, reverse osmosis, resin exchange and the like other than the electrodeposition may be employed as the removing method of the above impurities.

The solution circulated to the step (I) is utilized again for refining of unrefined gold according to the steps previously mentioned.

While the yield in the case of no circulation of the solution (ratio of unrefined gold employed to refined gold obtained) is about 95%, the yield can be raised to 98~99% by circulating the solution.

All of the residual gold of 1~2% is recovered from the apparatus, and is then supplied to the said apparatus after appropriate treatment.

Each step of the above reactions of the invention can be shown by the following general equations.

STEP I (Anode Chamber)

$$3\ KI \rightarrow 3/2\ I_2 + 3e^- + 3\ K^+ \quad (1)$$

$$Au + 3/2\ I_2 + KI \rightarrow KAuI_4 \quad (2)$$

(Cathode Chamber)

$$3\ K^+ + \tfrac{1}{2}\ KIO_3 + 3/2\ H_2O + 3\ e^- \rightarrow \tfrac{1}{2}\ KI + 3\ KOH \quad (3)$$

STEP II

No reactions

STEP III $$KAuI_4 + 3\ KOH \rightarrow Au + \tfrac{1}{2}\ KIO_3 + 7/2\ KI + 3/2\ H_2O \quad (4)$$

STEPS IV & V

No reactions

The left sides of the reaction equations are added to provide the equation below.

$$3\ KI + Au + 3/2\ I_2 + KI + 3K^+ + \tfrac{1}{2}KIO_3 + 3/2\ H_2O + 3\ e^- + KAuI_4 + 3KOH$$

On the other hand, the right sides of the reaction equations are added to provide the equation below.

$$3/2\ I_2 + 3\ e^- + 3\ K^+ + KAuI_4 + \tfrac{1}{2}\ KI + 3\ KOH + Au + \tfrac{1}{2}\ KIO_3 + 7/2\ KI + 3/2\ H_2O$$

The both sides perfectly coincide with each other.

In other words, the chemical reaction of the circulation purification process is a complete closed reaction so that no addition of the reagents is necessary and the purification continues semipermanently by supplying only the electric power required in the step (1).

Since slight consumption of the reagents takes place in reality, a minimum amount of the reagent is required, but the reagent added is only potassium iodide, one of the raw materials.

The reason for being able to continue the refining without adding the reagents in the circulation refining process of this invention is that gas evolution is inhibited so as not to upset the mass balance in spite of the employment of the electrolysis reaction.

The latter process of the invention comprises, in the refining of the unrefined gold employing iodine and/or the iodide compound, forming the solution containing the iodide compound of gold by dissolving the unrefined gold by the iodine or the like produced by the electrolysis, removing the insoluble substances in the solution, selectively reducing and precipitating the ions containing gold in the solution by making the pH of the solution strongly basic which is not less than 12 by the employment of the alkali hydroxide produced in the electrolysis with the iodine, separating the precipitated gold from solution and further circulating the solution freed from the gold for reuse.

Therefore, firstly, the use of such a drastic medicine reagent as aqua regia and and the treatment of the evolved gas is unnecessary, and the electrolysis efficiency is remarkably improved.

Secondly, since the electrolysis is employed for the iodine formation and the gold dissolution, the alkali hydroxide is simultaneously produced with the iodine by the electrolysis. Since the alkali hydroxide can be employed as the alkali source in the gold precipitation process and both compounds can be electrolytically produced by the same electric power, the economic advantages can be considerably increased by omitting the installation of auxiliary equipment and the purchase of reagents.

Thirdly, since in the circulation process of the invention no gases are evolved in the electrolysis, the mass balance never goes wrong even when the electrolyte is circulated. Therefore, the solution composition supplied to the electrolytic cell for forming iodine and dissolving gold is always constant, and the operation can be continued semipermanently by supplying the unrefined gold and a little iodine source without adding other reagents to obtain the gold of high purity to provide the remarkable technical and economic advantages compared with the prior refining technique of gold.

Even when the former process is employed for gold refining, gold of high purity is obtained with the rise of electrolysis efficiency. The use of drastic reagents and the treatment of evolved gas are also unnecessary in the process.

DESCRIPTION OF THE PREFERRED EMBODIMENT

The present invention will be fully described by referring to the preferred embodiment thereof. However, the invention should not be construed to be limited thereto.

The FIGURE is a flow chart showing one embodiment of the invention in which iodine is generated by diaphragm electrolysis and dissolution of unrefined gold is carried out in the same electrolytic cell employing the iodine.

A solution of potassium iodide is placed in an anode chamber 2 of an electrolytic cell 4 for producing iodine which is divided into the anode chamber 2 and a cathode chamber 3 by a fluorine-containing cation exchange membrane 1, and a solution of potassium iodate is placed to the cathode chamber 3. A plate-like electrode made of unrefined gold for a dimensionally stable electrode made of a titanium plate or the like coated with such a noble metal as platinum is employed as an anode 5. An electrode made of an ordinary electrode material such as stainless steel is employed as a cathode 6.

When the electric current is flown through the electrolytic cell 4, all or part of the potassium iodide is electrolyzed in accodance with the above reaction equation (1) to produce iodine and potassium ions, the potassium ions permeating through the ion exchange memberane 1 into the cathode chamber 3 to produce potassium hydroxide therein by an electrolysis reaction.

The anolyte containing the potassium iodide in the anode chamber 2 is supplied through a conduit 7 into the left chamber of an anolyte reservoir 9 divided into the two chambers by a partition wall 8, and part of the anolyte overflows the partition wall into the right chamber to circulate to the anode chamber 2 through a conduit 10. The solution in the left chamber of the anolyte reservoir 9 is supplied through a conduit 11 into a cylindrical reaction vessel 12 of which an upper side is open and of which a lower side is provided with a tapered portion directing the center thereof. In the reaction vessel are accommodated a number of unrefined gold particles 13 which are sufficiently contacted with the solution in the reaction vessel 12 by a stirrer 14 to react with the iodine and the iodide ions to be dissolved into the solution as gold iodide ions in accordance with the above reaction equation (2) or (2'). On the side of the reaction vessel 12 is connected a conduit 16 for circulating the solution in the reaction vessel 12 to the anode chamber 2 of the electrolytic cell 4 and for leading said solution to a reduction vessel 15 in which the dissolved gold is reduced and precipitated.

The apparatus for refining gold comprises means whereby after the operation for precipitating ions other than gold contained in the solution which contains the iodide compound of gold is conducted to increase the quantity of the impurities, the impurities are removed in the removing means.

In the conduit 16 is inserted a removing vessel 17 in which insoluble substances in the solution are removed by simple filtration, or filtration after various precipitation operations or by a combination with ultrafiltration to raise the purity of the gold which will be obtained. In many cases, the combination with the ultrafiltration is necessary to obtain the gold having the purity of not less than 99.999% by refining the unrefined gold. Part of the solution after being freed from the insoluble substances in the removing vessel 17 is recirculated to the electrolytic cell 4, and the other part is supplied to the reduction vessel 15.

The catholyte in the cathode chamber 3 of the electrolytic cell 4 is supplied through a conduit 18 to a right chamber of a catholyte reservoir 20 divided into the two chambers by a partition wall 19, and part of the catholyte overflows the partition wall 19 into the left chamber to circulate to the cathode chamber 3 through a conduit 21. The solution in the right chamber of the catholyte reservoir 20 is supplied to the reduction vessel 15 through a conduit 23 in which a filter 22 for removing dust and the like is inserted.

The reduction vessel 15 is a tank for precipitating the gold by mixing the anolyte supplied and the basic catholyte. Any tank may be employed in so far as the tank has the structure for mixing the two solutions to sufficiently contact the gold iodide ions with the potassium hydroxide solution. A tank equipped with a proper stirrer is preferable.

The gold iodide ions are reduced to be precipitated as metallic gold in the reduction vessel 15 according to the reaction equation (4).

The solution containing the precipitated gold is moved through a conduit 24 to a centrifugal separation apparatus 25 and the remaining solution in the reduction vessel 15 is moved through a conduit 26 to a cylindrical reservoir 27. The gold having been separated from the solution by the centrifugal separation apparatus 25 is dried and recovered in a drying device 28 such as a rotary kiln. Potassium iodide and potassium iodate are dissolved in the remaining solution having been recovered from the gold, which solution is circulated to the electrolytic cell 4 for reuse without disposal.

The solution in the centrifugal separation apparatus 25 is led through a conduit 29 to a washing solution reservoir 30, which is supplied to the centrifugal separation apparatus 25 without further treatment or after it is distilled in an adjacent distilling vessel 31. A concentrated solution produced in the distilling vessel 31 is moved through a conduit 32 to the reservoir 27. The solution in the reservoir 27 is circulated through a conduit 33 to the anolyte reservoir 9 for use as anolyte without further treatment, or is circulated to the catholyte reservoir 20 for reuse as catholyte after it is supplied to a plate electrolytic cell 35 having no diaphragms through a conduit 34 so that metals in the solution are deposited on electrodes 36, 37.

An excessive amount of potassium iodide and potassium iodate is dissolved in the circulated solution re-electrolyzed in the anode chamber 2 and in the cathode chamber 3 so that the reaction for forming iodine by electrolysis of the potassium iodide takes place in the anode chamber 2 and the reaction for forming potassium hydroxide by electrolysis of the potassium iodate takes place in the cathode chamber to repeat the abovedescribed cycle.

Although in this embodiment the solution is circulated and the auxiliary equipment such as the electrolyte reservoirs 9,20, the washing water reservoir 30, the distilling vessel 31, the reservoir 27 and the plate electrolytic cell 35 is employed, the solution need not be circulated and the said equipment can be omitted.

Examples of the process of this invention will be hereinafter described.

EXAMPLE 1

A box-like electrolytic cell having 20 cm of length, 40 cm of width and 30 cm of height was divided into an anode chamber and a cathode chamber by a fluorine-containing cation exchange membrane having sulphonic acid groups. A gold plate of 99.99% of purity having 180 mm of length, 250 mm of width and 8 mm of thickness (6950 g) and a stainless steel plate having 180 mm of length, 250 mm of width and 2 mm of thickness were supported in the electrolytic cell as an anode and a cathode, respectively.

Each of the anode chamber and the cathode chamber was filled with a 10l-solution of potassium iodide (456.6 g/l) and potassium iodate (53.5 g/l) of which pH is adjusted to be 12.8 by means of potassium hydroxide. The anode chamber was connected with a cylindrical reaction vessel having about 50 cm of inner diameter and about 50 cm of height and containing gold particles (about 5000 g) of which purity is 99.99% of purity so that the anolyte was circulated.

Electrolysis was carried out maintaining the electrolyte temperature and the current density at about 50° C. and 20 A/dm$^2$, respectively. After 60 minutes, the ionic concentration of the gold iodide ion in the anolyte was detected to be about 0.23 mole/l.

From the lapse of about 60 minutes, the anolyte was continuously taken out from the electrolytic cell through a conduit to a precipitation vessel. After the metals other than gold were removed therein, the anolyte was led to a reduction vessel having 20 cm of inner diameter and 30 cm of depth. The catholyte in which potassium hydroxide had been produced was led to the reduction vessel after being passed through the precipitation vessel. After the two electrolytes were mixed under vigorous agitation, the pH of the mixed solution became about 12.8, and the precipitation of gold began. After the precipitated gold was separated by centrifugal separation, washed and dried, the purity of the gold was found to be 99.999% and the particle size was found to be 15$\mu$.

The solution freed from the gold was divided into two portions, one of which was circulated to the cathode chamber of the electrolytic cell after it was passed through a plate electrolytic cell of 20 l of volume having a stainless steel plate of 15 cm$\times$25 cm as a cathode and a titanium plate coated with platinum of 15 cm$\times$25 cm as an anode under 2 A/dm$^2$ via a reservoir, and the other part was similarly circulated to the anode chamber.

After the lapse of about 6 hours from the commencement of the electrolysis, the electrolysis was stopped. The decreased amounts of the unrefined gold as anode and the gold particles in the reaction chamber were measured to be 945 g and 1832 g, respectively.

On the other hand, the total weight of the gold obtained by the purification was 2538 g, and the yield was 95%. The purity thereof was 99.999%. The residual gold of 139 g was recovered from the plate electrolytic cell as the gold of 98.4% of purity.

EXAMPLE 2

Refining of gold was carried out employing the apparatus similar to that used in Example 1. In this Example, an electrode made of titanium coated with platinum was used as anode instead of the gold, and the gold particles (99.5% of purity) were accommodated only in the reaction vessel. The gold particles in the reaction vessel which decreased in accordance with the progress of the electrolysis were supplemented and 5 g of potassium iodide per day was also supplemented so that the electrolysis was continued for three months under the current density of 2 A/dm$^2$.

Among the total weight of the unrefined gold particles of 95.0 kg, the gold of 89.6 kg was dissolved and refined. The total weight of the refined gold was 87.8 kg (98% of yield), and the purity was 99.996%. The residual gold of 1.8 kg was recovered from the plate electrolytic cell. Silver (0.38 kg) other than the gold was obtained from the plate electrolytic cell and the precipitation vessel.

EXAMPLE 3

Refining of gold was carried out similar to Example 1 except that the solution was not circulated.

The purity and the yield of the gold obtained was 99.91% and 98% respectively and the particle size was 15$\mu$. The residual gold remained unreduced in the solution.

What is claimed is:

1. A process of refining gold comprising:

(a) forming a solution containing an iodide compound of gold in the anode chamber of an electrolytic cell by dissolving unrefined gold by means of iodine and/or an iodide compound, and alkali hydroxide in the cathode chamber;

(b) converting soluble metal-containing impurities in the solution into the corresponding insoluble metal oxides and/or hydroxides;

(c) removing the oxides and/or hydroxides together with insoluble impurities already present in the solution, from the solution;

(d) reducing ions containing gold in the solution by making the pH of the solution strongly basic which is not less than 12 by means of alkali hydroxide; and (e) separating the precipitated gold from the solution after the reduction.

2. A process for refining gold according to claim 1, wherein water is added to the solution containing the iodide compound of gold so that a soluble iodide compound is forced to be precipitated.

3. A process for refining gold according to claim 1, wherein the conversion operation is to control the pH of the solution containing the iodide compound of gold between 8 to 12 so that hydroxides and/or oxides of metals other than gold are forced to be precipitated.

4. An apparatus for refining gold comprising:

(a) an electrolytic cell for forming a solution containing an iodide compound of gold by the reaction of unrefined gold with iodine and/or an iodide compound, which is divided by a diaphragm into an anode chamber and a cathode chamber and electrolyzes an iodine compound-containing electrolyte to form an alkali hydroxide and iodine in the cathode chamber and the anode chamber respectively, (b) a converting means for converting soluble metal-containing impurities in the solution into the corresponding insoluble metal oxides and/or hydroxides;

(c) a removing means for removing the oxides and/or hydroxides together with insoluble impurities already present in the solution, from the solution;

(d) a reduction vessel for reducing and precipitating gold from the iodide compound of gold by making the pH of the solution strongly basic which is not less than 12 by virtue of mixing the solution freed from the impurities through the removing means and the alkali hydroxide produced in the above electrolysis, which is connected with both the removing means and the cathode chamber of the electrolytic cell;

(e) a separating means for obtaining refined gold by separating the precipitated gold from the solution after reduction, and, (f) a means for circulating the solution separated from the refined gold into the electrolytic cell for reuse.

5. An apparatus for refining gold according to claim 4, wherein the formation of the iodine by diaphragm electrolysis and the reaction between the unrefined gold and the iodine and/or the iodide compound are carried out in a single cell.

6. An apparatus for refining gold according to claim 4, wherein the electrolysis is carried out by employing the unrefined gold as the anode.

7. An apparatus for refining gold according to claim 4, wherein the unrefined gold is unrefined gold which are accommodated in the anode chamber to be dissolved into the anolyte by electrolysis.

8. An apparatus for refining gold according to claim 4, wherein the anode chamber is connected with a reaction vessel accommodating unrefined gold particles to circulate the anolyte between the anode chamber and the reaction vessel so that the unrefined gold particles are dissolved in the reaction vessel.

9. An apparatus for refining gold according to claim 4, wherein removal of the impurities in the solution containing the iodide compound of gold is conducted by filtration or sedimentation in the removing means.

10. An apparatus for refining gold according to claim 9, wherein an ultrafiltration vessel is provided after the removing means so that ultrafiltration is carried out in the ultrafiltration vessel.

11. An apparatus for refining gold according to claim 9, wherein after an operation for precipitating ions other than gold contained in the solution which contains the iodide compound of gold is conducted to increase the quantity of the insoluble impurities, the impurities are removed in the removing means.

12. An apparatus for refining gold according to claim 11, wherein the precipitation operation is to add water to the solution containing the iodide compound of gold so that a soluble iodide compound is forced to be precipitated.

13. An apparatus for refining gold according to claim 11, wherein the precipitation operation is to control the pH of the solution containing the iodide compound of gold between 8 and 12 so that hydroxides and/or oxides of metals other than gold are forced to be precipitated.

14. A process for refining gold comprising:

(a) electrolyzing an electrolyte containing an iodide compound in an electrolytic cell using a diaphragm to form an alkali hydroxide and iodine in a cathode chamber and an anode chamber respectively to provide a solution containing an iodide compound of gold byt he reaction between unrefined gold and the iodine and/or the iodine compound in the anode chamber;

(b) converting soluble metal-containing impurities in the solution into the corresponding insoluble metal oxides and/or hydroxides;

(c) removing the oxides and/or hydroxides together with insoluble impurities already present in the solution, from the solution;

(d) reducing the iodide compound of gold to precipitate gold by adding the alkali hydroxide produced in the electrolysis to the solution to make the pH of the solution strongly basic which is not less than 12;

(e) obtaining the refined gold by separating the precipitated gold from the solution after the reduction, and (f) circulating the solution separated from the refined gold to the electrolytic cell for reuse.

15. A process for refining gold according to claim 14, wherein removal of the impurities in the solution containing the iodide compound of gold is conducted by filtration or sedimentation.

16. A process for refining gold according to claim 14, wherein the particle size of the precipitated gold is forced to be grown by further adding the solution containing the iodide compound of gold to the solution containing the precipitated gold having been made strongly basic, and by making the pH of the combined solution strongly basic.

17. A process for refining gold according to claim 14 wherein the solution separated from the refined gold is subjected to further impurities removal in an electrolytic cell.

* * * * *